US009463625B2

(12) United States Patent
Oikawa

(10) Patent No.: US 9,463,625 B2
(45) Date of Patent: Oct. 11, 2016

(54) METHOD OF MANUFACTURING LIQUID EJECTION HEAD AND LIQUID EJECTION HEAD

(71) Applicant: CANON KABUSHIKI KAISHA, Tokyo (JP)

(72) Inventor: Satoshi Oikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/097,757

(22) Filed: Dec. 5, 2013

(65) Prior Publication Data

US 2014/0160205 A1 Jun. 12, 2014

(30) Foreign Application Priority Data

Dec. 6, 2012 (JP) ..... 2012-267469

(51) Int. Cl.
*B41J 2/16* (2006.01)
*B41J 2/14* (2006.01)

(52) U.S. Cl.
CPC ..... *B41J 2/1623* (2013.01); *B41J 2/14024* (2013.01); *B41J 2/1603* (2013.01); *B41J 2/14072* (2013.01); *B41J 2002/14491* (2013.01); *Y10T 29/49401* (2015.01)

(58) Field of Classification Search
CPC ..... B41J 2002/14491; B41J 2/14072; B41J 2/1623; B41J 2/14024; B41J 2202/20; B41J 2/1603
See application file for complete search history.

(56) References Cited

U.S. PATENT DOCUMENTS 7,712,870 B2 * 5/2010 Shibata et al. ..... 347/50
2013/0050345 A1 * 2/2013 Fukai ..... B41J 2/14072 347/54

FOREIGN PATENT DOCUMENTS

JP 2003072087 A 3/2003
JP 2006281736 A * 10/2006
JP 2007-320230 A 12/2007

OTHER PUBLICATIONS

Yasuda, Junji, "Inkjet Recording Head", Oct. 19, 2006, Paragraphs 0017, 0028, 0032-0033, 0049-0050, 0053-0054.*

* cited by examiner

*Primary Examiner* — Lisa M Solomon
(74) *Attorney, Agent, or Firm* — Canon U.S.A., Inc. IP Division

(57) ABSTRACT

A method of manufacturing a liquid ejection head including a liquid ejection substrate, an electric wiring member, and a supporting member having a first supporting surface and a second supporting surface, including: positioning an outer peripheral portion of the electric wiring member disposed on the side of the second supporting surface outside of the second supporting surface; providing the supporting member with the first depression at a position facing one part of the outer peripheral portion of the electric wiring member and the second depression connected to the first depression at a position facing another part of the outer peripheral portion having a width smaller than that of the first depression, and applying an adhesive agent in the first depression to cause part of the adhesive agent to flow into the second depression, so that the outer peripheral portion of the electric wiring member is adhered to the supporting member.

5 Claims, 4 Drawing Sheets

METHOD OF MANUFACTURING LIQUID EJECTION HEAD AND LIQUID EJECTION HEAD

BACKGROUND OF THE INVENTION

1. Field of the Invention

The present disclosure relates to a method of manufacturing a liquid ejection head configured to eject liquid and a liquid ejection head.

2. Description of the Related Art

An ink jet recording head as a liquid ejection head performs printing by ejecting ink supplied from an ink container in which ink is stored via an ink flow passage way member onto a recording medium such as paper. The ink jet recording head includes a recording element substrate in which a plurality of ejection openings for ejecting ink are arranged in a row.

The ink jet recording head receives electric power for printing signals or ejection of an ink jet recording apparatus. Therefore, the recording element substrate is electrically connected to a contact substrate which directly comes into contact with a contact portion of the ink jet recording apparatus via an electric wiring member. The recording element substrate and the electric wiring member are electrically connected to each other by a connection between a connecting pad provided on the recording element substrate and a lead of the electric wiring member.

In such a configuration, part of the electric wiring member of a flexible wiring substrate or the like is provided on the same side as a surface on which the recording element substrate is arranged. Therefore, when a printing operation is performed in a state in which a recording medium such as paper is curling up, an outer peripheral portion of the electric wiring member on the side where the recording element substrate is arranged comes into contact with the curling-up portion of the recording medium, which may cause damage of the electric wiring member.

In order to prevent such an event, the outer peripheral portion of the electric wiring member is adhered to a supporting portion with an adhesive agent on a surface where the recording element substrate is provided, so that the recording medium can hardly be caught thereby. In Japanese Patent Laid-Open No. 2007-320230, a configuration for bringing the outer peripheral portion of the electric wiring member to be adhered to the supporting portion is disclosed.

When an adhesive agent is applied to the outer peripheral portion of the electric wiring member, the size of the ink jet recording head is increased by an extent corresponding to the thickness of the adhesive agent. In particular, a mechanism configured to hold the recording medium provided in the ink jet recording apparatus is arranged in the vicinity of the outer peripheral portion in a direction orthogonal to a direction of feeding of the recording medium of the electric wiring member. Therefore, it is preferable to reduce the size of the ink jet recording head by reducing the thickness of the adhesive agent in the outer peripheral portion extending in the direction orthogonal to the direction of feeding of the recording medium of the electric wiring member.

A method shown below is known as a method of applying the adhesive agent to the outer peripheral portion of the electric wiring member. In other words, it is a method of applying the adhesive agent to the outer peripheral portion of the electric wiring member in the direction parallel to the direction of feeding of the recording medium and causing the adhesive agent to flow over the outer peripheral portion extending in the direction orthogonal to the direction of feeding of the recording medium of the electric wiring member by a capillary action. According to this method, a configuration in which the size of the ink jet recording head is reduced by reducing the thickness of the adhesive agent in the outer peripheral portion extending in the direction orthogonal to the direction of feeding of the recording medium of the electric wiring member is achieved.

The method described above is a method of applying the adhesive agent of an amount required for achieving adhesion of the entire circumference of the outer peripheral portion of the electric wiring member over part of an application area and causing the adhesive agent to flow over a portion to which the adhesive agent is not applied. Therefore, when the adhesive agent of the amount required in the method described above is applied to the application area in a short time, the adhesive agent flowing outward from the area to be applied with the adhesive agent may run to a backside surface, which causes a risk of contamination of the ink jet recording head. On the other hand, when the adhesive agent is applied at a speed considering an overflow of the adhesive agent to the outside, a time length required for the application of the adhesive agent is increased, and hence a time length taken from the start of application of the adhesive agent to a complete application of the adhesive agent over the entire circumference of the outer peripheral portion of the electric wiring member is increased.

SUMMARY OF THE INVENTION

This disclosure provides a method of manufacturing a liquid ejection head capable of reducing a time length required until an application of an adhesive agent to an outer peripheral portion of an electric wiring member is completed and ensuring adhesion of the outer peripheral portion of the electric wiring member while suppressing an overflow of the adhesive agent to the outside.

A method of manufacturing a liquid ejection head including a liquid ejection substrate configured to eject liquid, an electric wiring member configured to be electrically connected to the liquid ejection substrate, and a supporting member having a first supporting surface configured to support the liquid ejection substrate and a second supporting surface configured to support the electric wiring member on the side of the first supporting surface, including: positioning an outer peripheral portion of the electric wiring member disposed on the side of the second supporting surface outside of the second supporting surface when viewed in a direction orthogonal to the second supporting surface; providing a first depression and a second depression in the supporting member, the first depression being provided at a position facing one part of the outer peripheral portion of the electric wiring member, and the second depression being connected to the first depression, provided at a position facing another part of the outer peripheral portion of the electric wiring member, which is different from the one part, and having a width in cross section orthogonal to a direction connected to the first depression smaller than a width of the first depression, and applying an adhesive agent to the first depression to cause part of the adhesive agent to flow into the second depression, so that the outer peripheral portion of the electric wiring member is adhered to the supporting member.

According to this disclosure, there may be provided a method of manufacturing a liquid ejection head capable of reducing a time length required until an application of an adhesive agent to an outer peripheral portion of an electric wiring member is completed and ensuring adhesion of the outer peripheral portion of the electric wiring member while suppressing an overflow of the adhesive agent to the outside.

Further features of the present invention will become apparent from the following description of exemplary embodiments with reference to the attached drawings.

DESCRIPTION OF THE EMBODIMENTS

Referring now to FIG. 1 and FIGS. 2A to 2C, an ink jet recording head H100 as a liquid ejection head of this disclosure will be described.

Figure 1:
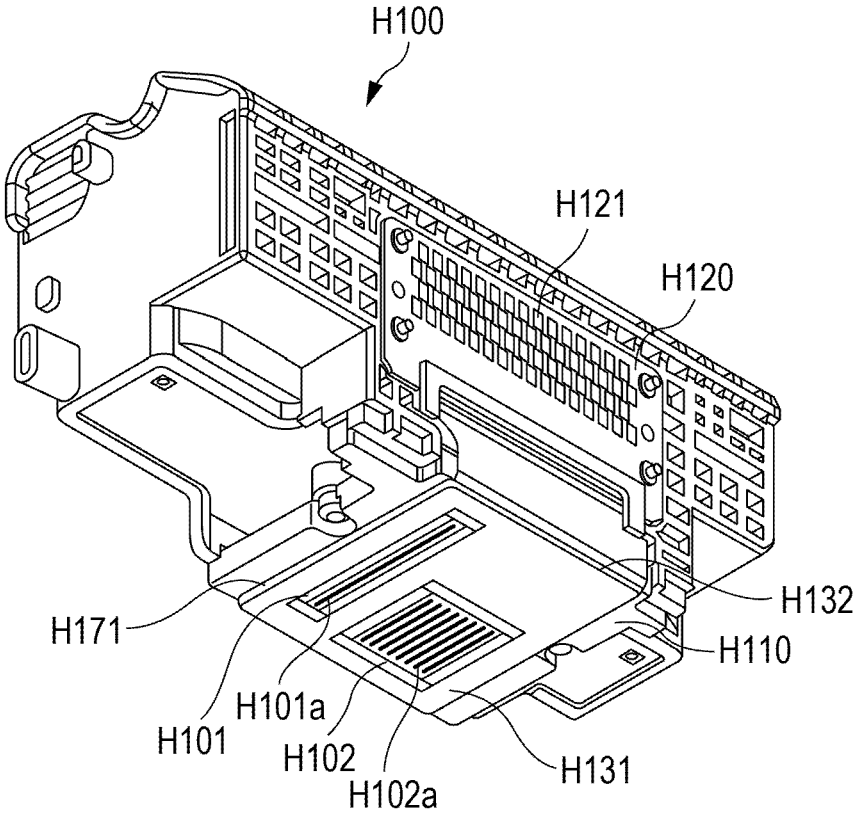
FIG. 1 is a perspective overview of an ink jet recording head of this disclosure.
Figure 2A:
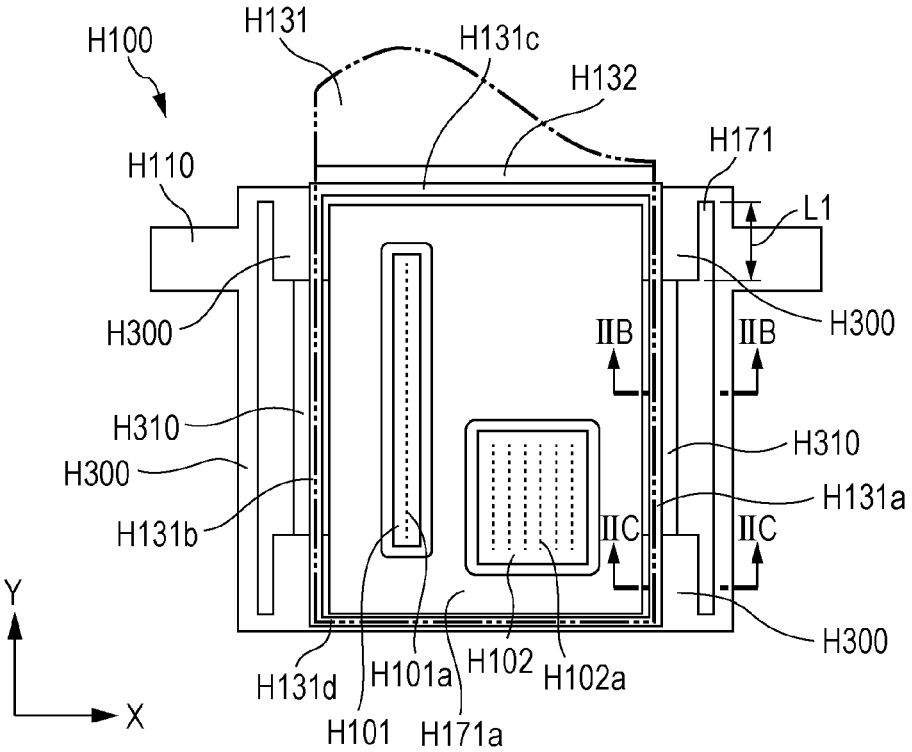
FIGS. 2A to 2C are schematic drawings illustrating the ink jet recording head of this disclosure.
Figure 2B:
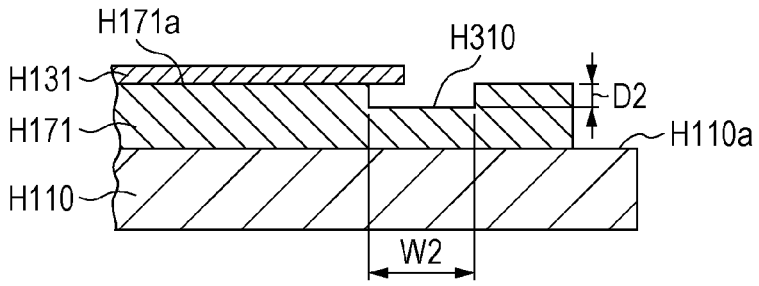
Figure 2C:
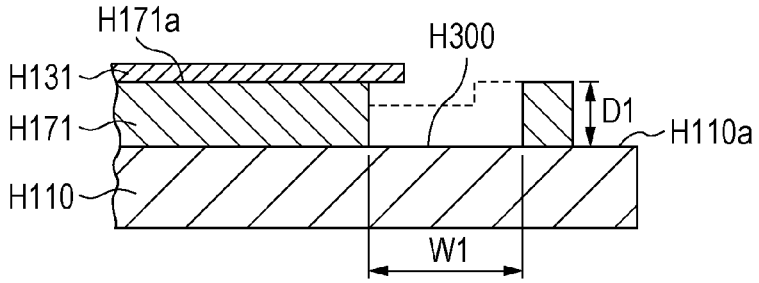

FIG. 1 is a perspective overview of the ink jet recording head H100. FIG. 2A is a schematic drawing of the ink jet recording head H100 viewed from the side of ejection openings. FIG. 2A is a drawing illustrating a second supporting member H171 provided under an electric wiring member H131 through the electric wiring member H131 (illustrated in double-dashed chain line). FIGS. 2B and 2C are schematic drawings taken along a line IIB-IIB and a line IIC-IIC in FIG. 2A, respectively.

The ink jet recording head H100 includes an recording element substrate (liquid ejection substrate) H101 provided with an ejection opening array H101*a* in which a plurality of ejection openings for ejecting liquid are arranged in rows, a recording element substrate H102 provided with an ejection opening array H102*a*, a first supporting member H110, and the second supporting member H171. The second supporting member H171 is provided with an opening (first opening) surrounding the recording element substrates H101 and H102. As illustrated in FIGS. 2A to 2C, the recording element substrates H101 and H102 and the second supporting member H171 are arranged so as to be supported by a supporting surface H110*a* (first supporting surface) of the first supporting member H110.

The electric wiring member H131 is a member for feeding a signal or electric power for causing ink to be ejected from a main body of an ink jet recording apparatus to the recording element substrates H101 and H102. The electric wiring member H131 is electrically connected to a contact substrate H120 (see FIG. 1) including a contact pad H121, which comes into direct contact with a contact portion of the main body of the ink jet recording apparatus. Wiring laid in the interior of the electric wiring member H131 is electrically connected to the recording element substrates H101 and H102 via connecting pads provided on the outer peripheries of the recording element substrates H101 and H102. The electric wiring member H131 is provided with an opening (second opening) surrounding the recording element substrates H101 and H102 in the same manner as the second supporting member H171, and is arranged on a supporting surface H171*a* (second supporting surface) of the second supporting member H171. The second supporting member H171 is a height-adjusting member for aligning the height of the electric wiring member H131 to the heights of the recording element substrates H101 and H102 provided on the first supporting member H110 for an electrical connection thereof.

As illustrated in FIG. 2A, an outer peripheral portion of the electric wiring member H131 is protruded outward from the supporting surface H171*a* when viewed from a direction orthogonal to the supporting surface H171*a*, that is, the electric wiring member H131 is supported by the supporting surface H171*a* on the inner side of the outer peripheral surface thereof. The electric wiring member H131 is a flexible wiring substrate, and is bent (FIG. 1) at a bending portion H132 in a state in which the ink jet recording head H100 is completed, but in FIG. 2A, a state before being bent is schematically illustrated.

The outer peripheral portion of the electric wiring member H131 is adhered to the supporting member having the supporting surfaces H110*a* and H171*a* via an adhesive agent. The appellation of the supporting member here collectively includes the first supporting member H110 and the second supporting member H171.

The outer peripheral portion of the electric wiring member H131 positioned on the outside of the supporting surface H171*a* is formed with depressions to which the adhesive agent is to be applied at positions facing peripheral edges H131*a* and H131*b* in the direction along the ejection opening arrays H101*a* and H102*a* (Y-direction in FIG. 2A).

Specifically, first depressions H300 are formed at four corners of the electric wiring member H131 which correspond to positions facing ends of the peripheral edges H131*a* and H131*b* in the Y-direction of the electric wiring member H131 (FIGS. 2A and 2C). The first depressions H300 each include the supporting surface 110*a* of the first supporting member H110 as a bottom surface and the second supporting member H171 as a side surface. As illustrated in FIG. 2A, the second supporting member H171 forming the side surfaces of the first depressions H300 is formed into an angular U-shape opening toward the outside in the Y-direction.

Second depressions H310 are formed at positions facing parts of the insides of the above-described ends of the peripheral edges H131*a* and H131*b* in the Y-direction of the electric wiring member H131 (FIGS. 2A and 2B). The second depressions H310 are grooves formed in the second supporting member H171 along the Y-direction so as to be connected to the first depressions H300. As illustrated in FIGS. 2B and 2C, a width W2 of the second depressions H310 becomes smaller than a width W1 of the first depressions H300, and a depth D2 of the second depressions H310 is shallower than a depth D1 of the of the first depression H300. The width W2 of the second depressions H310 corresponds to the length of the second depressions H310 in a cross-section orthogonal to a direction connected to the first depressions H300.

In contrast, the depression as described above is not provided at positions facing peripheral edges H131*c* and H131*d* of the electric wiring member H131 in a direction intersecting the ejection opening arrays H101*a* and H101*b* (X-direction). Since roller mechanisms for holding a recording medium provided on the ink jet recording apparatus are arranged in the vicinities of the peripheral edges H131*c* and H131*d* of the electric wiring member H131, the size of the ink jet recording head H100 in the Y-direction is preferably as small as possible. Therefore, the first depressions H300 and the second depressions H310 are arranged only at the positions facing the peripheral edges H131*a* and H131*b* of the electric wiring member H131. In this embodiment, the supporting surface H110*a* of the first supporting member H110, which is the same surface as the bottom surface of the first depressions H300, is provided at the position facing the peripheral edges H131*c* and H131*d* of the electric wiring member H131.

Figure 3:
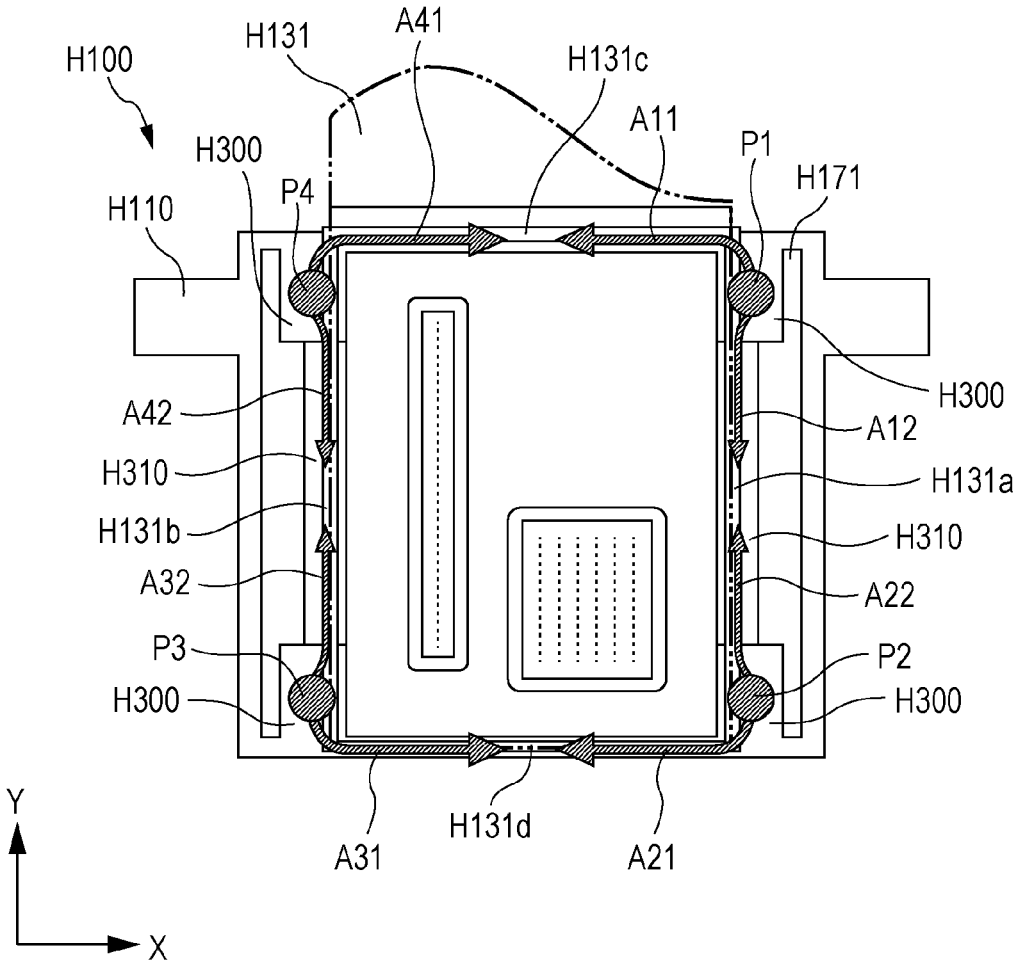
FIG. 3 is a schematic drawing illustrating a method of manufacturing the ink jet recording head of this disclosure.

Subsequently, a method of adhesion of the outer peripheral portion of the electric wiring member H131 will be described with reference to FIG. 3. FIG. 3 is a drawing for explaining application of the adhesive agent to the outer peripheral portion of the electric wiring member H131.

In this embodiment, the adhesive agent is applied only to four application points P1, P2, P3, and P4 of the adhesive agent of the first depressions H300. Portions of the first depressions H300 other than the ends in the Y-direction are formed with side surfaces by the second supporting member H171. Therefore, the adhesive agent is suppressed from being overflowed to the outside of the first supporting member H110, so that application of the adhesive agent at a high speed is achieved.

Since the adhesive agent is applied to the point P1 described above by an amount which brings the height of the liquid surface of the adhesive agent to a level higher than the bottom surface of the second depression H310, the adhesive agent after the application flows in both directions indicated by arrows A11 and A12. Here, the first depressions H300 are deeper than the second depressions H310, and hence the liquid surface of the adhesive agent applied to the first depressions H300 becomes the same height as the liquid surface of the adhesive agent in the second depressions H310. Subsequently, when the level of the liquid surface of the adhesive agent in the first depressions H300 become lower than the level of the liquid surface of the adhesive agent in the second depressions H310, the adhesive agent flows only in the direction indicated by the arrow A11.

The adhesive agent flows to the peripheral edge H131*c* of the electric wiring member H131 from the application points P1 and P4 provided on both sides thereof. Therefore, an inner volume V1 ($V1=L1\times W1\times(D1-D2)$ where L1 is the length of the first depressions H300 (see FIG. 2A)) of a portion positioned at a position lower than the bottom surface of the second depressions H310 at the application point P1 of the first depressions H300, may be set as follows. In other words, the sum of the inner volume V1 and an inner volume V4 of the application point corresponding thereto may be set to be equal to or larger than the volume of the adhesive agent required for adhesion of the peripheral edge H131*c* of the electric wiring member H131 to the supporting surface H110*a*. In this configuration, adhesion of the peripheral edge H131*c* of the electric wiring member H131 is ensured with the adhesive agent flowing from the application point P1 in the direction indicated by the arrow A11 and the adhesive agent flowing from the application point P4 in the direction indicated by the arrow A41.

Since the configurations of other three application points P2, P3, and P4 are the same as the application point P1, the adhesive agent flows in the manner described above and the outer peripheral portion of the electric wiring member H131 is adhered to the supporting member.

In this manner, distribution of the adhesive agent over the entire circumference of the outer peripheral portion of the electric wiring member H131 may be ensured by differentiating the positions of the height of the bottom surfaces of the first depressions H300 and the second depressions H310.

When the sizes of the respective peripheral edges of the electric wiring member H131 are different, the relationship between the inner volume of the first depressions H300 and the depth of the second depressions H310 may be adjusted corresponding to the required amounts of the adhesive agent, respectively.

Figure 4A:
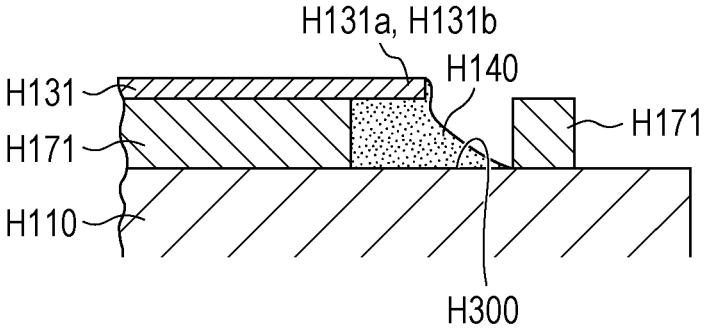
FIGS. 4A to 4C are schematic drawings illustrating the ink jet recording head partly in cross-section of this disclosure.
Figure 4B:
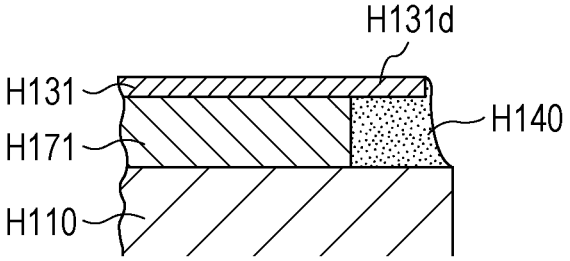
Figure 4C:
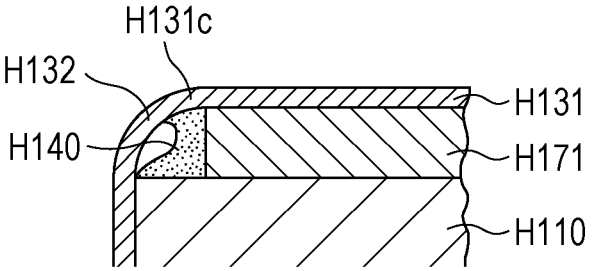

FIGS. 4A to 4C are schematic cross-sectional drawings illustrating a state in which the respective peripheral edges of the electric wiring member H131 are adhered to the supporting member. FIG. 4A illustrates a state of the portions of the peripheral edges H131*a* and H131*b* extending along the Y-direction of the electric wiring member H131 including the first depressions H300. FIG. 4B illustrates a state of the peripheral edge H131*d* extending along an X-direction. FIG. 4C illustrates a state of the peripheral edge H131*c* provided on the side of the bending portion H132 of the electric wiring member H131 and extending along the X-direction.

As illustrated in FIGS. 4A and 4B, an adhesive agent H140 is applied to an angular U-shaped portion composed of the peripheral edges H131*a*, H131*b*, and H131*d* of the electric wiring member H131, the second supporting member H171, and the first supporting member H110. As illustrated in FIG. 4C, in the peripheral edge H131*c* on the side of the bending portion H132 of the electric wiring member H131, the adhesive agent H140 is applied to a tubular portion formed by being surrounded by the electric wiring member H131, the first supporting member H110, and the second supporting member H171.

As illustrated in FIG. 4A, in the first depressions H300 in which the adhesive agent is directly applied, the adhesive agent H140 is protruded a little from the angular U-shaped portion. As illustrated by using FIG. 3, the adhesive agent H140 applied to the first depressions H300 flows to the second depressions H310 having a width smaller than that of the first depressions H300 and a portion between the peripheral edges H131*a* and H131*b* of the electric wiring member H131 and the supporting member is filled with the adhesive agent H140. As regards the peripheral edges H131*c* and H131*d* of the electric wiring member H131, the adhesive agent flows into the angular U-shaped portion or the interior of the tubular portion by a capillary action, so that the adhesive agent is applied as illustrated in FIGS. 4B and 4C. Consequently, the entire circumference of the outer peripheral portion of the electric wiring member H131 and the supporting member may be adhered with the adhesive agent.

As described above, in this embodiment, the adhesive agent is applied only in the first depressions H300 having a larger groove width and provided at a position facing corner portions of the outer peripheral portion of the electric wiring member H131. Since the adhesive agent is applied only to the first depressions H300 having a larger groove width, overflow of the adhesive agent to the outside may be suppressed. Accordingly, breakage of the electric wiring member H131 due to the contact with the recording medium may be suppressed, and an ink jet recording head having a high reliability may be manufactured.

The position of the first depressions H300 is not limited to the configuration of the above-described embodiment. In other words, if a configuration in which the first depressions H300 and the second depressions H310 being connected to the first depressions H300 and having a groove width smaller then the first depressions H300 are provided at positions facing the outer peripheral portion of the electric wiring member H131, the same effect is achieved only by applying the adhesive agent to the first depressions H300. In particular, by providing the first depressions H300 at the positions facing the corner portions of the outer peripheral portion of the electric wiring member H131 as in this embodiment, the adhesive agent is distributed from the corner portions over the entire circumference of the outer peripheral portion of the electric wiring member H131, so that the outer peripheral portion of the electric wiring member H131 may be adhered reliably in a shorter time.

In this embodiment, the first depressions H300 are each formed of two members, which are first supporting member H110 and the second supporting member H171. However, a configuration in which the first depressions H300 are each formed of one member is also applicable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-267469, filed Dec. 6, 2012, which is hereby incorporated by reference herein in its entirety.

What is claimed is:

1. A liquid ejection head comprising:

a liquid ejection substrate configured to eject liquid;

an electric wiring member electrically connected to the liquid ejection substrate; and a supporting member having a first supporting surface configured to support the liquid ejection substrate and a second supporting surface configured to support the electric wiring member on the side of the first supporting surface, wherein an outer peripheral portion of the electric wiring member disposed on the side of the second supporting surface is positioned on an outside of the second supporting surface when viewed in a direction orthogonal to the second supporting surface, the supporting member includes a first depression and a second depression, wherein the first depression and the second depression are each depressions made in the second supporting surface, and wherein a first portion of the first depression is provided at a position facing a first part of the outer peripheral portion of the electric wiring member, the second depression is connected to the first portion of the first depression and a second portion of the first depression, and is provided at a position facing a second part of the outer peripheral portion of the electric wiring member, and the second portion of the first depression is provided at a position facing a third part of the outer peripheral portion of the electric wiring member, the first, second and third parts of the outer peripheral portion of the electric wiring member each being different from one another, and wherein the second depression has a width in cross section, orthogonal to a direction in which the second depression is connected to the first depression, smaller than a width of the first depression, and the electric wiring member and the supporting member are adhered to each other at least via an adhesive agent applied to the first depression and the second depression, wherein the first depression and the second depression are provided along one side of the outer peripheral portion of the electric wiring member arranged successively in order of a first portion of the first depression, the second depression and a second portion of the first depression, and are not provided in parallel to each other.

2. The liquid ejection head according to claim 1, wherein the first portion of the first depression is provided at a position facing a corner of the outer peripheral portion of the electric wiring member.

3. The liquid ejection head according to claim 1, wherein the first depression is deeper than the second depression from the second supporting surface.

4. The liquid ejection head according to claim 1, wherein the electric wiring member is provided with a bending portion, and wherein the adhesive agent is applied to at least a step of the supporting member in a region between the bending portion and the supporting member.

5. The liquid ejection head according to claim 4, wherein the region between the bending portion and the supporting member has a region where the adhesive agent is not applied in a vicinity of the bending portion.

* * * * *